US005871408A

United States Patent [19]

Chen

[11] Patent Number: 5,871,408

[45] Date of Patent: Feb. 16, 1999

[54] METHOD FOR FUSING A BALL-STRIKING PLATE WITH A GOLF CLUB HEAD CASE

[76] Inventor: Archer C. C. Chen, No. 501, 28th Road, Taichung Industrial Park, Taichung, Taiwan

[21] Appl. No.: 892,097

[22] Filed: Jul. 14, 1997

[51] Int. Cl.[6] ..... A63B 53/04

[52] U.S. Cl. ..... 473/409; 473/342; 473/350; 228/164; 29/428

[58] Field of Search ..... 473/324, 345, 473/346, 329, 349, 350, 409, 343, 342; 29/527.2, 527.6, 463, 428; 164/76.1; 228/125, 164

[56] References Cited

U.S. PATENT DOCUMENTS 5,261,663 11/1993 Anderson ..... 473/345
5,386,996 2/1995 Hiruta ..... 473/346
5,433,440 7/1995 Lin ..... 473/345
5,518,240 5/1996 Igarashi ..... 473/345
5,669,825 9/1997 Shira ..... 473/349

*Primary Examiner*—Sebastiano Passaniti
*Attorney, Agent, or Firm*—Browdy and Neimark

[57] ABSTRACT

A method for fusing a ball-striking plate with a golf club head case comprises a first step in which a metal head case is prepared such that the metal head case is provided with a recess having a shoulder. A metal ball-striking plate is also prepared such that the ball-striking plate is corresponding in size and shape to the recess of the head case. A welding material is arranged on the shoulder of the recess of the head case before the ball-striking plate is arranged in the recess of the head case. The head case containing the ball-striking plate is then baked in an oven at a temperature higher than the melting point of the welding material, thereby resulting in the fusion of the ball-striking plate with the head case by the molten welding material.

6 Claims, 2 Drawing Sheets

METHOD FOR FUSING A BALL-STRIKING PLATE WITH A GOLF CLUB HEAD CASE

FIELD OF THE INVENTION

The present invention relates generally to a method for making a golf club head, and more particularly to a method for fusing a ball-striking plate with a case of the golf club head.

BACKGROUND OF THE INVENTION

The conventional method for fusing a ball-striking plate of a titanium alloy material with a golf club head case of a stainless steel material is generally composed of the formation of a recess in the club head case to accommodate the ball-striking plate, which is then fused to the club head case by welding. Such a conventional method as described above is defective in design in that the ball-striking plate is fused securely with the case, and that there is always a small slit formed between the ball-striking plate and the case, and further that the fused area of the ball-striking plate and the case is vulnerable to crack caused by the impact of a ball hitting the ball-striking late, and still further that the weld mark left on the welded area must be removed by an additional finishing work which results in an increase in the cost of making the golf club head.

SUMMARY OF THE INVENTION

The primary objective of the present invention is to provide a method for fusing a ball-striking plate with a golf club head case effectively. The method is free from the drawbacks of the conventional method described above.

In keeping with the principle of the present invention, the foregoing objective of the present invention is attained by the method, which consists of an initial step of preparing a metal golf club head case provided with a recess having a cavity and a shoulder. A ball-striking plate of a metal material is also prepared such that the ball-striking plate has a size and a shape permitting the plate to be accommodated in the recess. Before the ball-striking plate is arranged in the recess, a welding material is arranged appropriately on the shoulder. After the ball-striking plate is arranged in the recess of the head case, the head case is baked in an oven in the presence of an inert gas at the temperature higher than the melting point of the welding material so as to fuse the ball-striking plate securely with the golf club head case.

The foregoing objective, features, functions and advantages of the present invention will be more readily understood upon a thoughtful deliberation of the following detailed description of the present invention with reference to the accompanying drawings.

DETAILED DESCRIPTION OF THE INVENTION

Figure 1:
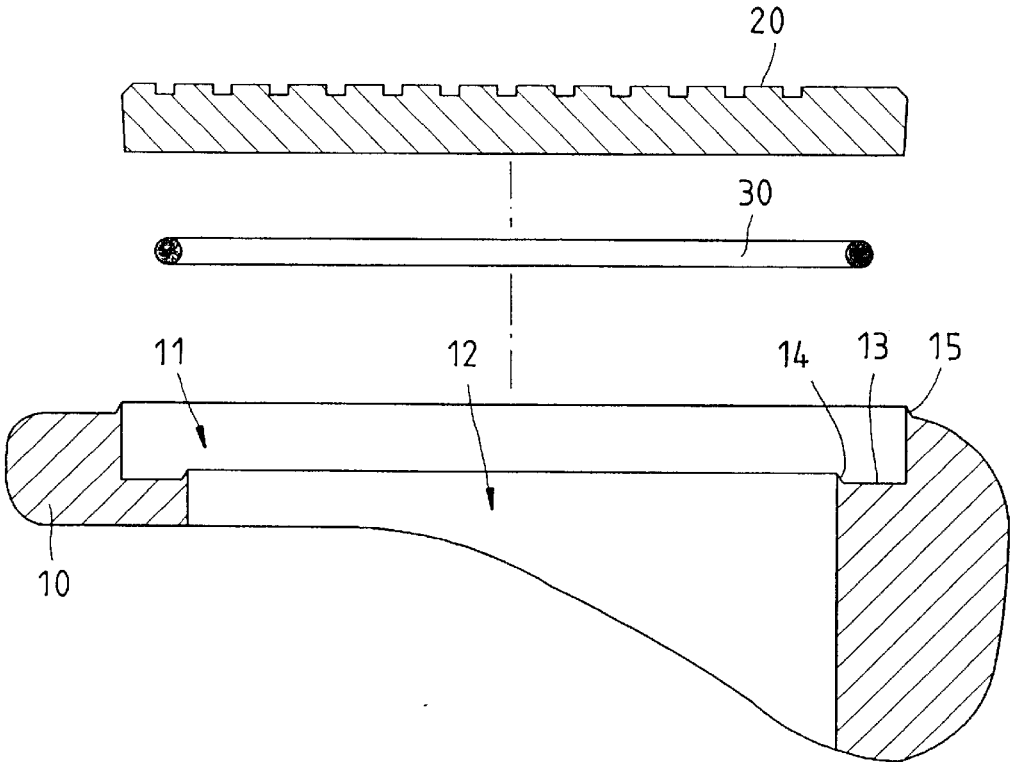
FIG. 1 is a schematic view illustrating the initial step of the method of the present invention.
Figure 2:
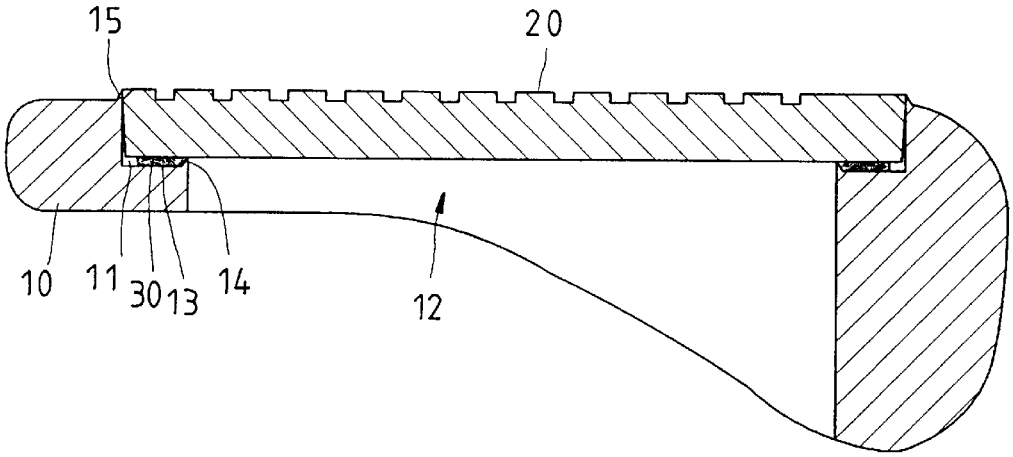
FIG. 2 is a schematic view illustrating the method of the present invention in progress.
Figure 3:
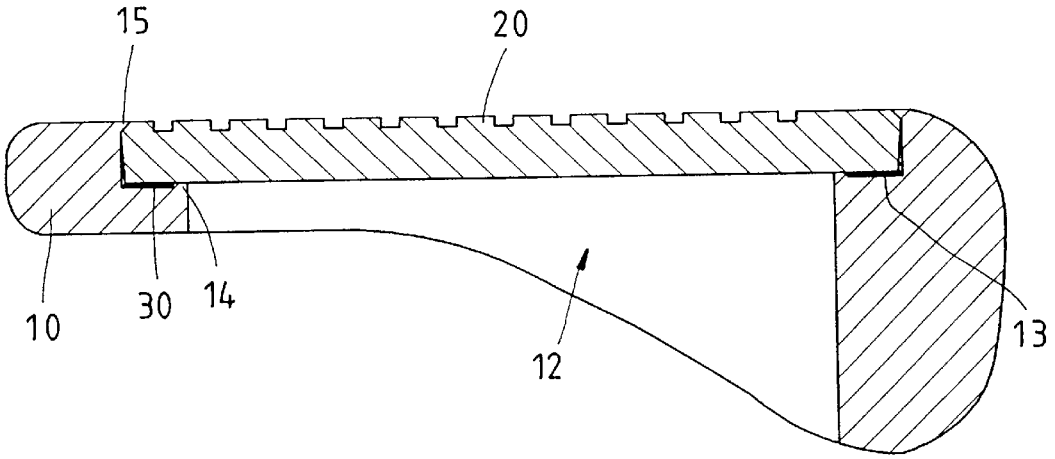
FIG. 3 is a schematic view illustrating the final stage of the method of the present invention.
Figure 4:
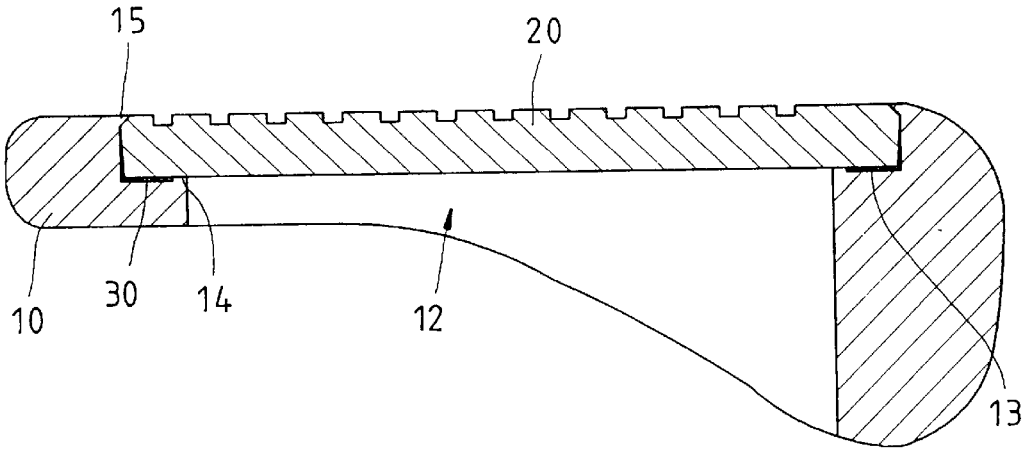
FIG. 4 shows a schematic view of the end product of the method of the present invention.

As illustrated in FIGS. 1–4, the method embodied in the present invention involves a first step in which a golf club head case 10 of a stainless material is prepared in such a manner that the case 10 is provided with a recess 11 having a through hole 12 and a shoulder 13. The shoulder 13 is located in the bottom of the recess 11 and is provided in the outer edge thereof with a projected portion 14 facing the ball-striking face of the golf club head. In the meantime, the recess 11 of the case 10 is provided along the fringe thereof with a protruded area 15. Thereafter, a ball-striking plate 20 of a maraging steel or titanium alloy material is prepared such that the ball-striking plate 20 has a size and a shape permitting the plate 20 to be arranged in the recess 11 to form the ball-striking face of the golf club head. Before the ball-striking plate 20 is accommodated in the recess 11 of the case 10, a welding bar 30 made of a mixture containing copper, nickel, aluminium and other metals is arranged on the shoulder 13. The ball-striking plate 20 is arranged in the recess 11 of the case 10 such that the underside of the ball-striking plate 20 presses the projected portion 14, which is thus deformed slightly. In addition, the protruded portion 15 is also flattened to ensure that the fringes of the ball-striking plate 20 is in intimate contact with the case 10. The case 10 containing the ball-striking plate 20 is subsequently baked in a vacuum oven or in a high-temperature oven containing an inert gas. The baking temperature should be higher than the melting point of the welding bar 30 but lower than the melting points of the metal materials of which the case 10 and the plate 20 are made. The ball-striking plate 20 is fused securely with the case 10 by the molten metals of the welding bar 30. According to the embodiment of the present invention, the baking temperature is 1050° C., which is lower than the melting point of 1600° C. of the stainless steel of the case 10 and the melting point of 1500° C. of the titanium alloy of the ball-striking plate 20. In other words, the baking temperature ranges between 750° C. and 1100° C., depending on the materials of which the case 10, the plate 20 and the welding bar 30 are made. The baking time ranges between 4 and 5 hours.

The embodiment of the present invention described above is to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A method for fusing a ball-striking plate with a golf club head case, said method comprising the steps of:

(a) preparing a golf club head case of a metal material such that the golf club head case is provided with a recess having a shoulder located in the bottom of the recess;

(b) preparing a ball-striking plate of a metal material such that the ball-striking plate is corresponding in size and shape to the recess of the golf club head case;

(c) arranging a welding material on the shoulder of the recess of the golf club head case;

(d) arranging the ball-striking plate in the recess of the golf club head case such that the underside of the ball-striking plate is in contact with the welding material;

(e) baking the golf club head case of the step (d) in an oven at a temperature higher than the melting point of the welding material for a period lasting between 4 and 5 hours;

(f) removing the baked case from the oven and wherein the shoulder of the recess of the golf club head case has a deformable projection for enhancing the fusion of the ball-striking plate with the recess of the golf club head case.

2. The method as defined in claim 1, wherein the recess of the golf club head case is provided along the fringe thereof with a protruded area for preventing the spilling of the molten welding material.

3. The method as defined in claim 1, wherein the oven is a vacuum oven.

4. The method as defined in claim 1, wherein the oven is a high-temperature oven containing an inert gas.

5. The method as defined in claim 1, wherein the golf club head case is made of a stainless steel material; wherein the ball-striking plate is made of a titanium alloy material; and wherein the welding material is made of a mixture containing copper, nickel and aluminium.

6. The method as defined in claim 5, wherein the temperature of the oven in the step (e) is 1050° C.

* * * * *